US006361034B1

(12) United States Patent
Wolfe

(10) Patent No.: US 6,361,034 B1
(45) Date of Patent: Mar. 26, 2002

(54) MAGNETIC INSERT IN JAW PLATE FOR HOLDING VISE PARALLELS

(75) Inventor: Ingo E. Wolfe, Brooklyn Park, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 0 days.

(21) Appl. No.: 09/261,449

(22) Filed: Mar. 3, 1999

(51) Int. Cl.[7] ..... B25B 11/00

(52) U.S. Cl. ..... 269/8; 269/43; 269/276; 269/247

(58) Field of Search ..... 269/8, 43, 249, 269/247, 900, 276

(56) References Cited

U.S. PATENT DOCUMENTS 3,575,435 A * 4/1971 Lemanski ..... 269/8
4,316,605 A * 2/1982 Zachry et al. ..... 269/43
4,392,643 A 7/1983 Campeau
4,558,856 A 12/1985 Shaffer
4,569,511 A 2/1986 Bell, Jr.
5,060,920 A 10/1991 Engibarov
5,222,997 A 6/1993 Montgomery
5,711,515 A * 1/1998 Nishimura ..... 269/276

FOREIGN PATENT DOCUMENTS

GB 2144062 * 2/1985 ..... 269/276

OTHER PUBLICATIONS

New! Aluminum Magnetic Parallels, advertisement sheet by Performance Tooling Inc., published as early as Jan. 1, 1999.

* cited by examiner

*Primary Examiner*—Joseph J. Hail, III
*Assistant Examiner*—Lee Wilson
(74) *Attorney, Agent, or Firm*—Westman, Champlin & Kelly, P.A.

(57) ABSTRACT

A magnetic holder of a vise jaw that has a permanent magnet mounted in the jaw for holding metal or other magnetic material workpiece support parallels in position against the jaw clamping surface to properly hold the parallels during the clamping operation. The vise jaw can be used with a jaw plate that forms part of the jaw. The jaw plate has through holes or bores through which the mounting screws pass for bolting it to the main jaw and a bore for mounting the parallel retaining magnet. The jaw plates can be used either on fixed or movable jaws, or both.

2 Claims, 2 Drawing Sheets

MAGNETIC INSERT IN JAW PLATE FOR HOLDING VISE PARALLELS

BACKGROUND OF THE INVENTION

The present invention relates to a vise jaw, or jaw plate, which has magnetic inserts imbedded therein that are used for securing in place vice parallels, which are used for orienting and holding workpieces to be clamped in a vise.

In the past, the holding of parallel bars used for workpiece supports in place in a vise when a workpiece is to be clamped has been primarily by mechanical devices that hold the parallels against the jaw or jaw plates. U.S. Pat. No. 5,222,997 shows such a parallel holder device using telescoping tubes for holding the parallels against the clamping surfaces.

Additionally, an earlier device for holding parallels in place is shown in U.S. Pat. No. 4,558,856.

Magnetic parallels, in which magnets are placed into the parallels themselves are shown in U.S. Pat. No. 5,711,515. Also, jaw pads that include magnets have been used as shown in U.S. Pat. No. 4,569,511.

Performance Tooling, Inc. of Grand Rapids, Mich., has made aluminum magnetic parallels that are sold in sets, using a thin magnetic strip running along the length of the aluminum parallel.

U.S. Pat. No. 4,392,643 shows a magnetic hold-down tool which is used in connection with a workpiece and a vise but which has magnets that hold it into position on the vise jaw.

Most machine shops will have a wide variety of metal parallels already purchased, and the present invention makes the use of these standard parallels easier by securing them in place on the vise clamping surface.

SUMMARY OF THE INVENTION

The present invention relates specifically to vise jaws or jaw plates having magnets in them, so the jaw clamping surfaces can support metal parallel surface workpiece supports or "parallels". A magnet is positioned in a hole or bore extending inwardly through the clamping surface. Preferably, a hole is provided in a jaw plate with a magnet in the hole and carried with the jaw plate. Only one magnet needs to be used because it will be in a position where the workpiece support or parallel that is held can be forced down against the guideways of the vise and held in position positively by the magnetic insert in the jaw plate itself. The jaw plate can have the conventional openings for mounting screws that hold the jaw plate on the vise jaw. More than one magnet can be used if desired.

Preferably, the magnets are permanent ceramic discs, that are surrounded by conformable non-magnetic sleeves that will permit a press-fit into a bore in the metal jaw or jaw plate.

Magnetic insert jaw plates can be used on single jaw vises, or double jaw vises as desired, and can be used on both fixed and movable jaws.

Wherever jaw plates are used, including multiple clamp assemblies, the magnetic insert jaw plate can be placed.

DETAILED DESCRIPTION OF THE PREFERRED EMBODIMENTS

Figure 1:
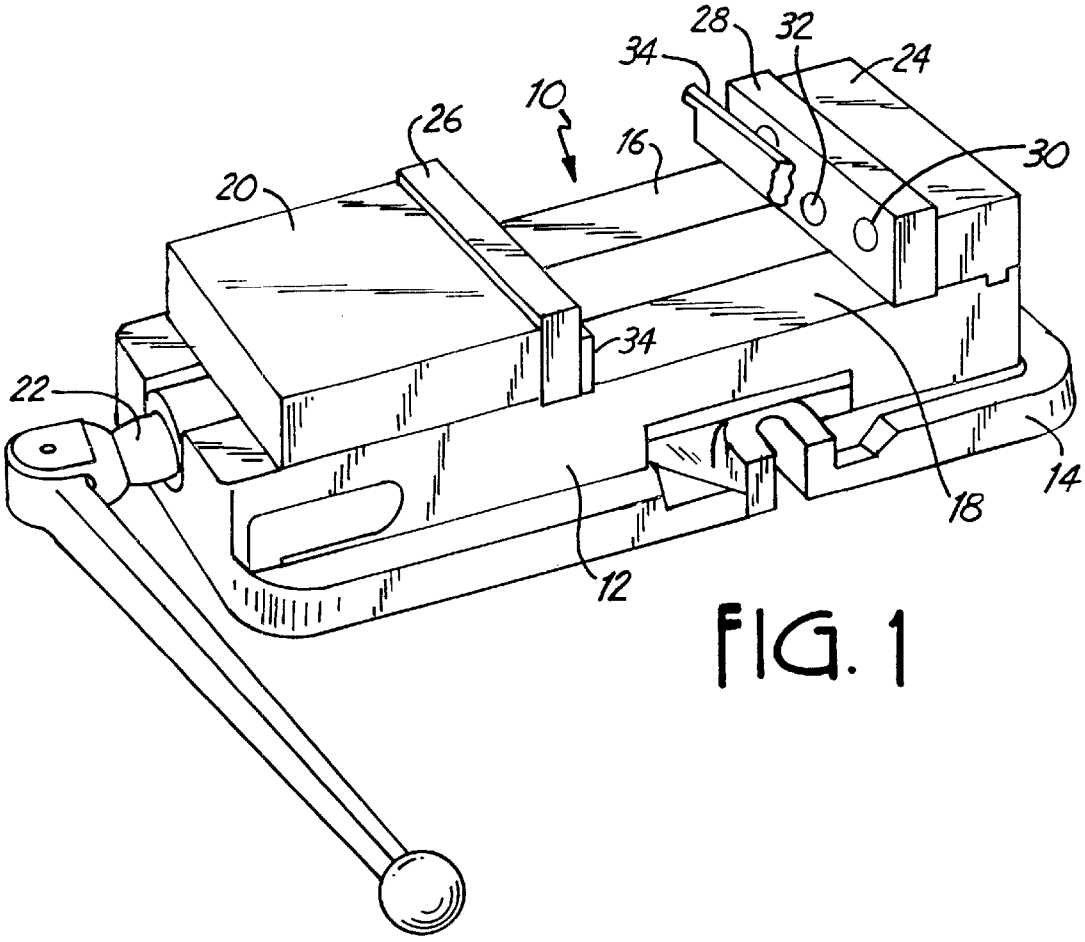
FIG. 1 is a schematic perspective view of a typical vise having a magnetic insert jaw plate made according to the present invention installed thereon.

In FIG. 1, a machine vise indicated generally at 10, has a vise base 12, that includes a plate 14 to be clamped onto a tool table or other work stand. The vise 10 has a pair of rails 16 and 18 forming guideways on which a movable jaw block 20 can be moved by turning a vise screw 22. A fixed jaw block 24 is provided at an opposite end of the vise from the movable jaw 20, so that a workpiece could be clamped in positions between clamping surfaces of the fixed jaw and the movable jaw.

The movable jaw, as shown, has a jaw plate 26 thereon, and the fixed jaw has a jaw plate 28. The jaw plate 28, as shown, as well as the jaw plate 26, is fastened in place with suitable cap screws 30 extending through provided bores or holes 40 in the jaw plates. The jaw plate 28, as can be seen, has a bore in which a permanent magnet 32 is mounted, and this is used for holding a standard vise parallel 34 that is shown only schematically in position on the way surfaces 16 and 18, and in position to support a workpiece (not shown) as the workpiece is clamped between the clamping surface of the jaws.

Figure 2:
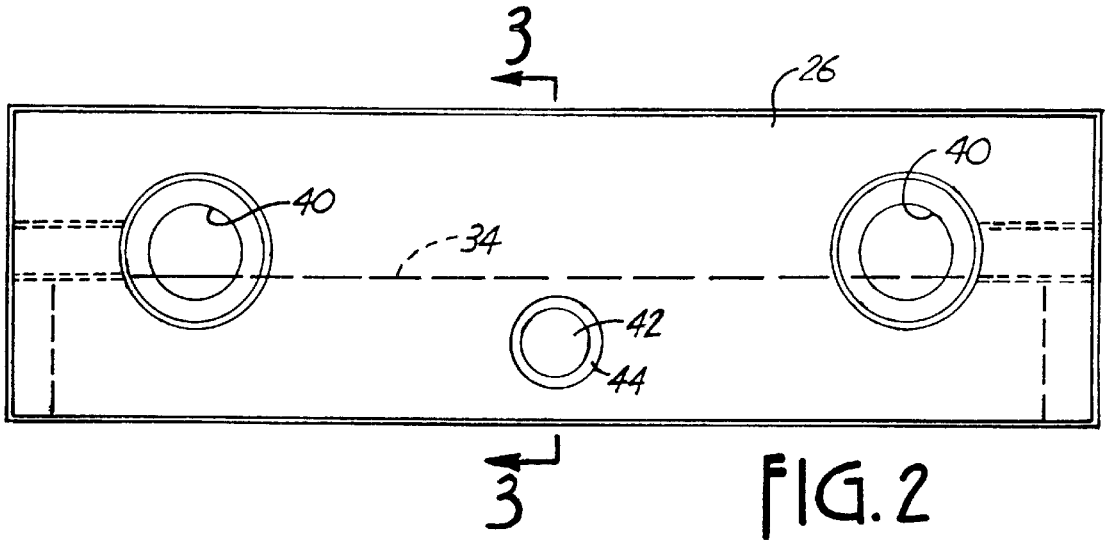
FIG. 2 is a front view of a magnetic jaw plate shown in FIG. 1.
Figure 3:
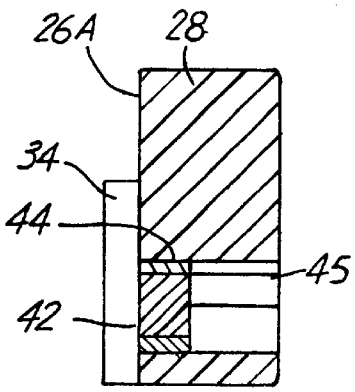
FIG. 3 is a sectional view taken as on line 3—3 in FIG. 2.

FIG. 2 is a front elevation view of a typical jaw plate, for example, the jaw plate 26, with the cap screws removed from the bores 40 which extend through the jaw plate 26. The jaw plate 26 is generally rectangular as shown, and is made of metal. The holes 40 are spaced apart and mount cap screws that clamp the haw plate in position in the center of the jaw plate on a line midway between the holes 40. A permanent magnet 42 is mounted in a hole or recess 45. The magnet 42 is surrounded with a sleeve of non-magnetic material, such as a bushing or sleeve 44. The bushing or sleeve 44 will disrupt any flux path between the magnet and the metal jaw plate, but the magnetic force is used for attracting a workpiece support parallel that is shown schematically at 34 in FIG. 3, and in dotted lines fragmentally in FIG. 2. The bore 45 can be formed into a jaw block of a vise, and thus into the clamping surfaced used, whether in a jaw block or in a jaw plate in which the sleeve 44 and the magnet 42 are mounted. The magnet and sleeve can be press fitted into the provided bore, so that it will stay in place, and it is maintained substantially flush, or preferably, slightly recessed, from the clamping face 26A of the jaw plate. Recessing the magnet slightly insures that the parallel will be held seated against the clamping face of the vise jaw.

Each of the jaw plates on a vise or clamp are preferably provided with such a magnet. The positioning is not critical, but as shown, a central position will ensure that only one magnet is needed for holding and securing the parallels that are to be attached.

The use of the ceramic magnet is greatly preferred, although other types of magnets can be used. The bushing or sleeve 44 can be plastic or bronze, for example.

Although the present invention has been described with reference to preferred embodiments, workers skilled in the art will recognize that changes may be made in form and detail without departing from the spirit and scope of the invention.

What is claimed is:

1. A metal jaw plate for a vise jaw having a pair of mounting holes for clamping the jaw plate onto the vise jaw to become integral with the vise jaw, the vise jaw having at least one additional bore therethrough extending from a front face to a rear face, a non magnetic material sleeve in the bore, and a cylindrical permanent magnet mounted within the sleeve in said additional bore and being adjacent to a plane of a clamping face of the jaw plate, the additional bore being centered on a line midway between the holes for clamping the law plate to the vise jaw.

2. The jaw plate of claim 1 wherein said magnet is a ceramic magnet.

* * * * *

UNITED STATES PATENT AND TRADEMARK OFFICE

CERTIFICATE OF CORRECTION

PATENT NO. : 6,361,034 B1
DATED : March 26, 2002
INVENTOR(S) : Ingo E. Wolfe

It is certified that error appears in the above-identified patent and that said Letters Patent is hereby corrected as shown below:

Column 3,
Line 6, cancel "law" and insert -- jaw --.

Signed and Sealed this

Twenty-sixth Day of November, 2002

*Attest:*

*Attesting Officer*

JAMES E. ROGAN
*Director of the United States Patent and Trademark Office*